US005341867A

United States Patent [19]

Yamada et al.

[11] Patent Number: 5,341,867

[45] Date of Patent: Aug. 30, 1994

[54] ELECTROMAGNETIC LEVITATION TYPE CONTINUOUS METAL CASTING APPARATUS

[75] Inventors: Masahiko Yamada; Yuji Harada; Hidemi Shigetoyo, all of Kanagawa, Japan

[73] Assignee: Showa Electric Wire & Cable Co., Ltd., Kawasaki, Japan

[21] Appl. No.: 112,693

[22] Filed: Aug. 25, 1993

Related U.S. Application Data

[63] Continuation of Ser. No. 906,009, Jun. 26, 1992, Pat. No. 5,244,034, which is a continuation of Ser. No. 619,866, Nov. 29, 1990, abandoned.

[30] Foreign Application Priority Data

Nov. 30, 1989 [JP] Japan ..... 1-313682
Nov. 30, 1989 [JP] Japan ..... 1-313683
Nov. 30, 1989 [JP] Japan ..... 1-313684

[51] Int. Cl.[5] ..... B22D 27/02; B22D 11/10

[52] U.S. Cl. ..... 164/502; 164/503; 164/439

[58] Field of Search ..... 164/466, 467, 502, 503, 164/443, 485, 439, 437, 488, 490, 440

[56] References Cited

U.S. PATENT DOCUMENTS 1,469,224 10/1923 Ladd .
1,535,231 4/1925 Lee .
2,816,334 12/1957 Edstrand .
3,522,836 8/1970 King .
3,591,052 7/1971 Nef .
3,605,863 9/1971 King .
3,872,913 3/1975 Lohikoski .
4,211,270 7/1980 Shinopoulos et al. .
4,349,145 9/1982 Shinopoulos et al. .
4,414,285 11/1983 Lowry et al. .
4,460,163 7/1984 Hornung .
4,865,116 9/1989 Peterson et al. .

FOREIGN PATENT DOCUMENTS 0114988 8/1984 European Pat. Off. .
62-227551 10/1987 Japan .
2080715 2/1982 United Kingdom .
2132925 7/1984 United Kingdom .

OTHER PUBLICATIONS

G. Ogiermann & R. Emmerich, "AufwartsstranggieBen edelmetallhaltiger Legierungen," *Metall*, 40 Jahrgang, Heft 1, at 22–26 (Jan. 1986).

(List continued on next page.)

*Primary Examiner*—Kuang Y. Lin
*Attorney, Agent, or Firm*—Ratner & Prestia

[57] ABSTRACT

An electromagnetic levitation type continuous metal casting apparatus includes a molten metal storing furnace for holding and storing a molten metal, a casting vessel for upwardly receiving and holding the molten metal in the form of an upwardly moving molten metal column, a displacer block for controlling supply of molten metal from the storing furnace to the casting vessel cooling means unified with the casting vessel and disposed around the outer periphery of the casting vessel for cooling and solidifying the upwardly moving molten metal column, alternating electromagnetic levitation and containment field generation means surrounding the casting vessel and cooling means disposed around the outer periphery thereof for generating an alternating electromagnetic field for electromagnetically levitating and containing the upwardly moving molten metal column while it is in the casting vessel, a molten metal supply path for supplying the molten metal to be cast from an inlet relatively high upon the side wall of the molten metal storing furnace vessel, a heat exchange (cooling) means wherein the direction of flow of the coolant in the cooling means is reversed in the area adjoining the second coil section from the lower end of a plurality of coil sections comprising levitating and containment field generation means. The molten metal supply path has a horizontal section, a bend section and a vertical section extending upwardly to the casting vessel and an appendix section secured to the bend section on the side thereof opposite the horizontal section with heating coils thereon for maintaining the temperature of the molten metal flowing through the bend section above its solidification temperature.

OTHER PUBLICATIONS

H. Lowry & R. Frost, "General Electric Levitation Casting (GELEC TM) Process," 1-11 (1984).

H. Lowry, "The GELEC TM Process for Low Cost Continuous Casting," 1-10 and FIGS. 1-7 (1984).

A. Braun & H. Burcher, "Dip-Forming Process for Copper Rod and its Special Application for Drawn Wires," Paper No. 2, 5th BNF International Conference (London, Sep. 1977).

H. Lowry, "Comparison of High and Low Oxygen Continuously Cast Rod in the Manufacture of Enameled Wire," International Wire & Machinery Ass'n, From Melt to Wire Conference (Spain, Ap. 1979).

Victor Pettersons Bokindustri AB, "ASEA" The Continuous Copper Rod Dip Forming Line at AB Elektrokoppar, Pamphlet No. AU 11-103E (Sweden, Mar. 1970).

ELECTROMAGNETIC LEVITATION TYPE CONTINUOUS METAL CASTING APPARATUS

This is a continuation of application Ser. No. 07/906,009, filed on Jun. 26, 1992 and issued as U.S. Pat. No. 5,244,034, which, in turn, is a continuation of abandoned application Ser. No. 07/619,866, filed on Nov. 29, 1990.

FIELD OF INVENTION

The present invention relates to an improved electromagnetic levitation type continuous metal casting apparatus.

BACKGROUND PRIOR ART

It is known that rods and tubes composed of metal can be produced by a continuous metal casting method as disclosed in U.S. Pat. No. 4,414,285. In this method, molten metal is upwardly supplied to a casting vessel (mold) where the molten metal is exposed to an alternating electromagnetic levitation and containment field which forms it into a column shape while being moved upwardly in the casting vessel. Simultaneously, the molten metal column is sequentially cooled and solidified, and the solidified metal product thereafter is removed from the top of the casting vessel by withdrawal rolls. This electromagnetic levitation type continuous metal casting method has been practically used as an industrially effective means of production. According to the aforementioned electromagnetic levitation type continuous metal casting method, a molten metal column to be cast or formed can be readily removed free from frictional forces and bonding forces against the sides of a casting vessel because the aforementioned alternating electromagnetic levitation and containment field produces a gravity-free state referred to as "pressureless contact." In addition, in such a method, while the molten metal column passes through the alternating electromagnetic field, the inside of the molten metal column is stirred and thereby high homogeneity can be accomplished.

A known prior art apparatus using the aforementioned continuous metal casting method is shown in FIG. 1. This apparatus comprises a molten metal storing furnace 2 for storing and holding a molten metal 1 and a tube-shaped casting vessel 3 vertically disposed for receiving the molten metal in the form of a column. So as to solidify the molten metal 1, a heat exchanger means 4 is unified with the casting vessel 3 for cooling and solidifying the molten metal column received into the casting vessel 3. An alternating electromagnetic field generation means 5 composed of a plurality of coils is disposed around the periphery of the casting vessel 3 and heat exchanger 4 for generating an alternating electromagnetic levitation and containment field that acts on the upwardly moving molten metal column. A means 6 such as withdrawal rolls is provided for removing the solidified metal product which has been cooled and solidified from the top of the casting vessel 3. A molten metal supply path 7 is provided for upwardly supplying the molten metal to be cast from the molten metal storing furnace 2 into the casting vessel 3. The molten metal supply path 7 is a tube formed of graphite or some similar refractory material with a high frequency heating means 8 disposed on the periphery thereof. Finally, a liquid level adjusting unit 9 is provided for adjusting the liquid level of the molten metal 1.

After extensive experience in operating a prior art production system using the aforementioned electromagnetic levitation type continuous metal casting method, several problems were encountered.

As one of the problems, the molten metal supply path 7 for upwardly supplying the molten metal 1 to be cast from the molten metal storing furnace 2 into the casting vessel 3 should continuously supply the molten metal 1 while keeping it in a molten state. For this purpose, a supply pipe with high conductivity material (such as graphite or other refractory material) is used and the high frequency heating means 8 is disposed around the periphery thereof. However, the molten metal supply path 7 extends horizontally to the casting vessel 3, which is vertically disposed, and requires an elbow section **7*b*. It is difficult to structure the high frequency heating means 8 around the elbow 7*b* and thus, the molten metal 1 cannot always be kept in the molten state. As a result, when the molten metal is supplied at the relatively low speed required when performing a low speed casting operation, the molten metal being supplied becomes partially cooled and tends to solidify at the bend section 7*b*, and the required amount of the molten metal 1 cannot be continuously supplied. Thus, in the molten metal supply path 7, an improvement of the apparatus for continuously supplying molten metal 1** is needed.

In the known electromagnetic levitation type continuous metal casting apparatus as shown in FIG. 2, which is an enlarged sectional view of the principal portion of the casting vessel of FIG. 1, the casting vessel 3, the heat exchange means 4, and the alternating electromagnetic field generation means 5 are formed in that order. The tube-shaped casting vessel 3 has a refractory-type heat conducting layer **3*a*, such as a graphite liner or the like, disposed on the inner wall thereof, and a flow path 4*a* of a cooling means (heat exchange means) surrounds layer 3*a*. In addition, around the full length of the outer periphery of the flow path of the cooling (heat exchange) means 4, a plurality of electromagnetic levitation coils (alternating electromagnetic field generation means) 5 are disposed. In such a structure, if the alternating electromagnetic field generation means 5 is composed of six sections of coils 5*a***, required full strength of the levitation electromagnetic field is obtained in the area adjoining the second section from both the ends thereof.

However, in the aforementioned electromagnetic levitation type continuous metal casting apparatus, there is the following problem. With reference to FIG. 1, the problem occurs as the molten metal column is supplied upwardly from the molten metal storing furnace 2 through the molten metal supply path 7 into the bottom of the casting vessel 3 where it is cooled and solidified by the heat exchange means 4. At that time, the molten metal column is electromagnetically and upwardly levitated by the alternating electromagnetic field generation means 5 and desired cast products, such as rods, are continuously produced. During this process, the rod often breaks. This is due to the fact that part of the molten metal column supplied upwardly to the casting vessel 3 is partially solidified in the area adjoining the lower coil **5*a*1, which is the first coil section from the bottom of the alternating electromagnetic field generation means 5, namely the area where levitating force and inwardly directed containment force cannot be satisfactorily obtained. Thus, the molten metal column is in contact with a cooled portion of the wall of the casting vessel 3, thereby disturbing smooth upward movement of the molten metal column. In an effort to solve such a problem in the wall area of the casting vessel 3 adjacent to coils 5a1 and coil 5a2, which are respectively the first and second coils from the bottom, a ceramic tube 3b is disposed and an air gap is disposed in the wall of the casting vessel 3** so as to decrease the thermal conductivity. However, in the aforementioned structure, the addition of these elements has not fully solved the problem.

Another problem is with respect to the molten metal supply path. In the prior art as shown in FIG. 3, an apparatus with a displacer 9 has been used. The displacer 9, upon being immersed in the molten metal 1 in the molten metal storing furnace 2, functions to supply the molten metal in the molten metal storing furnace to the casting vessel 3 through the molten metal supply path 7. In this prior art structure, the molten metal supply path 7 is connected to a side wall in the vicinity of the bottom of the molten metal storing furnace 2. The molten metal supply path 7 is composed of a horizontal section *7a*, a vertical section *7c*, and the bend section *7b* for connecting them. In this case, the molten metal supply path 7 for upwardly supplying the molten metal 1 to be cast from the molten metal storing furnace 2 into the casting vessel 3 is generally composed of a graphite tube with high thermal conductivity and a heating means, using high frequency heating coils or the like, disposed around the outer periphery of the graphite tube. The graphite tube is readily oxidized and eroded by oxygen in the air or the molten metal 1. In other words, the durability of the graphite tube is low. Additionally, there are many joints between the horizontal section *7a* and the molten metal storing furnace 2, between the horizontal section *7a* and the vertical section *7c* and between the vertical section *7c* and the connecting bend section *7b*. Repair and replacement of the joints are complicated, time consuming, and costly.

The possibility of the leakage of the molten metal 1 at such joints is increased further by the hydrostatic pressure produced by the molten metal 1 during the casting operation. In addition, in this prior art apparatus, repairing and replacing the-casting vessel or the molten metal transfer tube sections requires that the molten metal 1 in the molten metal storing furnace 2 be removed along with that in the casting vessel 3 and supply path 7. Such removal wastes time, some raw materials, and increases the cost of producing products. Therefore, an object of the present invention is to provide an electromagnetic levitation type continuous metal casting apparatus that facilitates decreasing or preventing the leakage of the molten metal 1 through the molten metal supply path 7. This results in an electromagnetic levitation type continuous metal casting apparatus free of both the need for complicated repair and too much replacement of joints in the molten metal supply path 7 together with the attendant loss of molten metal 1 flowing in the supply path 7 from the molten metal storing furnace 2. Additionally, it makes possible the repair and replacement of the casting vessel and molten metal supply path parts without requiring that the molten metal storing furnace be drained.

SUMMARY OF THE INVENTION

The electromagnetic levitation continuous metal casting apparatus according to one aspect of the invention, shown in FIG. 4, comprises a molten metal storing furnace for holding and storing molten metal, a casting vessel for upwardly receiving and holding the molten metal in the form of a molten metal column, and cooling means disposed around the outer periphery of the casting vessel for cooling and solidifying the molten metal column. The molten metal column, after solidification, is removed from the chamber by withdrawal rolls. Alternating electromagnetic field generation means are disposed around the outer periphery of the casting vessel for generating the alternating electromagnetic levitating and containment field. The alternating electromagnetic levitation and containment field electromagnetically levitates and contains the molten metal column received and held in the casting vessel.

A molten metal supply path 7 is provided for supplying the molten metal to be cast from the molten metal storing furnace to the casting vessel and high frequency heating means in the form of induction heating coils are disposed on the outer periphery of the molten metal supply path. The molten metal supply path comprises a horizontal section extending from the molten metal storing furnace and a vertical section disposed for upwardly supplying the molten metal into the casting vessel through a bend section. The bend section is provided with an appendix section *7d* horizontally disposed on a side of the vertical section away from the molten metal storing furnace and the appendix section has a high frequency heating means to prevent undesired solidification of the molten metal in the bend section.

The electromagnetic levitation type continuous metal casting apparatus according to a second feature of the invention comprises a molten metal storing furnace for holding and storing a molten metal. A casting vessel is vertically disposed for upwardly receiving the molten metal in the form of a molten metal column and cooling means in the form of a heat exchanger is disposed around its outer periphery. The level of the molten metal column in the casting vessel is moved upwardly or downwardly by the immersion or withdrawal of a displacer block into or from the molten metal holding furnace. An alternating electromagnetic levitation and containment field is provided by an alternating electromagnetic field generation means disposed around the outer periphery of the casting vessel and surrounding heat exchanger for generating the alternating electromagnetic levitation and containment field. The alternating electromagnetic levitation and containment field generation means is composed of a plurality of electromagnetic coils disposed on the outer periphery of the casting vessel. A molten metal supply path is provided for upwardly supplying the molten metal to be cast from the molten metal storing furnace into the bottom of the casting vessel and a high frequency heating means in the form of induction heating coils is disposed around the outer periphery of the molten metal supply path.

In this second feature, a two-way flow cooling means is provided for causing coolant to flow in two opposite directions past the molten metal column as it is solidifying and is structured so that the flow of the coolant is reversed in an area adjoining the second electromagnetic coil section from the lower-end of the plurality of electromagnetic coils.

The electromagnetic levitation type continuous metal apparatus according to a third feature of the invention further comprises a molten metal storing furnace for holding and storing a molten metal. A casting vessel is vertically disposed for upwardly receiving and holding the molten metal in the form of a molten metal column. An alternating electromagnetic levitation and containment field is produced by means surrounding the casting vessel for generating the alternating electromagnetic levitation and containment field. A cooling means is unified with the casting vessel and disposed around the outer periphery thereof for cooling and solidifying the molten metal column. The molten metal column is upwardly moved by the combined effect of gravity on the molten metal in the storing tank and a displacer block that can be immersed or withdrawn from the molten metal in the storing furnace. A molten metal supply path is provided for supplying molten metal to be cast from the molten metal storing furnace into the bottom of the casting vessel. High frequency heating means, in the form of induction heating coils disposed around the outer periphery of the molten metal supply path, and a displacer for raising and lowering the surface level of the molten metal in the molten metal storing furnace are provided for controlling supply of the molten metal into the casting vessel through the molten metal supply path 7. As shown in FIG. 6, the molten metal supply path extends substantially horizontally from an opening high up on the side wall of the molten metal storing furnace in a manner such that the position of the horizontally extending supply path opening into the storing furnace on the side wall is higher than the liquid surface of the molten metal in the storing furnace while the displacer is raised above the surface of the molten metal in the molten metal storing furnace.

In an alternative embodiment of this feature of the invention shown in FIG. 7, the horizontally extended molten metal supply path from the opening in the side wall is directly connected to the casting vessel through an integrally formed horizontal section, a bend section and a short vertical section without the use of interconnecting sections requiring joints with seals and the like.

BEST MODE OF PRACTICING THE INVENTION

By referring to the accompanying drawings, the best mode of practicing the present invention will be described.

Figure 4:
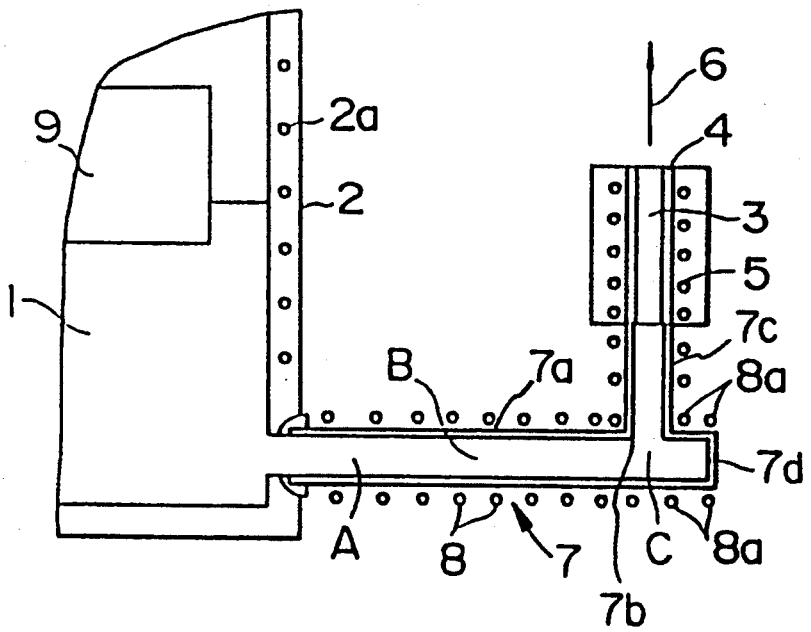
FIG. 4 is a sectional view showing the structure of the principal portions of an electromagnetic levitation continuous metal casting apparatus according to a principal feature of the present invention.

FIG. 4 is a sectional view showing the structure of the principal portions of an electromagnetic levitation type continuous metal casting apparatus according to a first feature of the invention. In FIG. 4, the reference numeral 2 is a molten metal storing furnace for holding and storing the molten metal 1. Reference numeral 3 is a casting vessel for forming and containing the molten metal 1 in the form of a vertically extending molten metal column from the bottom thereof. Reference number 4 is a heat exchanger (cooling means) surrounding and in thermal contact with the casting vessel 3. Reference numeral 5 is the alternating electromagnetic levitation and containment field generating means disposed around the outer periphery of the casting vessel 3 and heat exchanger 4 for generating an electromagnetic field for electromagnetically levitating and containing the molten metal column in the casting vessel 3.

Reference numeral 4 is the cooling means unified with the casting vessel 3 and disposed around the outer periphery thereof for cooling and solidifying the molten metal column in the casting vessel 3 and which initially is moved upwardly into the bottom of the casting vessel by the displacement of a displacer block number 9. While supported in casting vessel 3, the molten metal column is levitated and contained by the alternating electromagnetic field generation means 5 as explained in U.S. Pat. No. 4,414,285, for example. The cooling means 4 is a two-directional cooling fluid flow path and the reference numeral 7 is the molten metal supply path for upwardly supplying the molten metal 1 to be cast from the molten metal storing furnace 2 into the casting vessel 3. The molten metal supply path 7 may have any desired cross-sectional configuration, but preferably is cylindrical in cross-section. The reference numeral 8 is a high frequency heating means in the form of induction heating coils disposed on the outer periphery of the molten metal supply path 7. In FIG. 4, the reference numeral 2*a* is a high frequency heating means for keeping the molten metal 1 stored in the molten metal storing furnace 2 in the molten state and the reference numeral 9 is a molten metal liquid surface adjusting displacer member for controlling the level of the molten metal in storing furnace 2.

In the electromagnetic levitation type continuous metal casting apparatus according to FIG. 4, an appendix section 7*d* is provided with a high frequency heating means 8*a* in the form of induction heating coils at the bend section 7*b* that leads upwardly to casting vessel 3 from the horizontally extending molten metal supply path 7. In other words, according to the present invention, the electromagnetic levitation type continuous metal casting apparatus is provided with the appendix section 7*d* having high frequency induction heating coils 8*a* at the bend section (elbow section) 7*b* of the molten metal supply path 7 for assuring that the molten metal 1 to be cast is maintained in a molten condition until it reaches the casting vessel 3. In another embodiment of the invention shown in FIG. 7, the horizontal section 7*a*, the bend section 7*b*, the vertical section 7*c* and appendix section 7*d* all are unified into an integral supply path 7 for connection to furnace 2 without separate sections and joints that can spring leaks.

In this feature of the electromagnetic levitation type continuous metal casting apparatus, the molten metal supply path 7 and the appendix section 7*d* are made of a refractory material such as graphite or a fire-proof ceramic. Examples of suitable fire-proof ceramics for this purpose, but not limited thereto, are boron-type ceramics such as $TiB_2$, $ZrB_2$, $HfB_2$, $MoB_2$, $CrB_2$, and the like, nitride type ceramics such as TiN, ZrN, NbN, VN, and the like, and carbide type ceramics such as ZrC, HfC, VC, TiC, and the like.

The extended length of the appendix section 7*d* is determined by considering the material, length, diameter, and so forth of the molten metal supply path 7. In other words, the extended length is set to the length where the high frequency coil 8*a* can be wound at the bend section 7*b* of the molten metal supply path 7 and the appendix section 7*d* can supply heat enough to prevent the molten metal 1 from being solidified at the bend section 7*b*.

A copper rod was continuously cast by using electromagnetic levitation type continuous metal casting apparatus according to the feature of the invention shown in FIG. 4. The molten metal supply path 7 was comprised of all four sections 7*a*–7*d* composed of graphite tubes, and with the bend section 7*b* being provided with the appendix section 7*d* having the high frequency heating means 8*a*.

Figure 1:
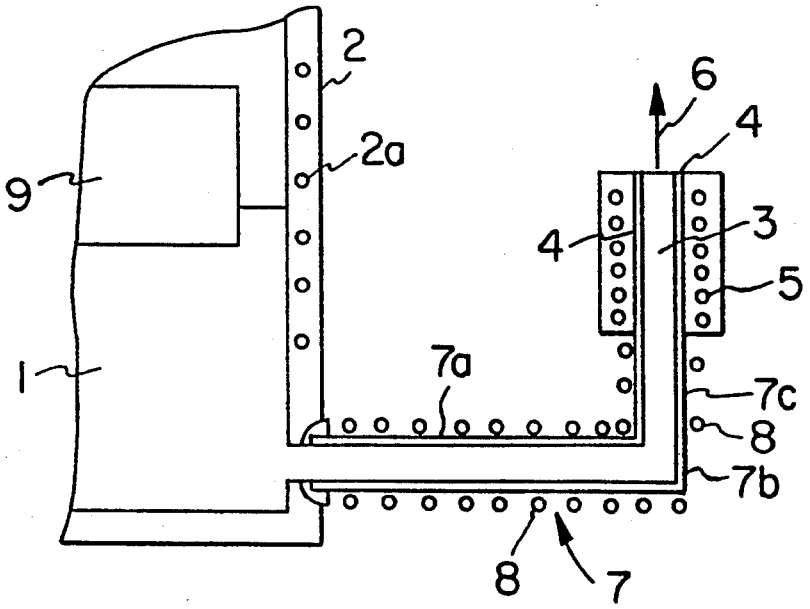
FIG. 1 PRIOR ART
FIG. 1 is a sectional view of the principal portions of a conventional electromagnetic levitation type continuous metal casting apparatus according to the prior art.
Figure 2:
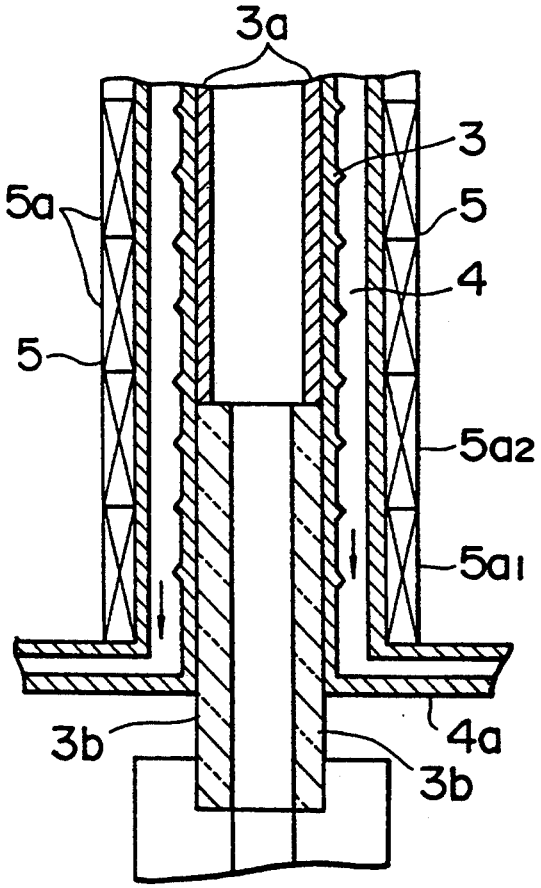
FIG. 2 PRIOR ART
FIG. 2 is an enlarged sectional view of the principal portions of a casting vessel of the prior art electromagnetic levitation type continuous metal casting apparatus shown in FIG. 1.

TABLE 1 shows the result of measurement of temperatures of molten metal at points A and B of the molten metal supply path 7 and point C of the bend section 7*b* shown in FIG. 4. In the table, the temperatures at points A and B of the molten metal supply path 7 and at point C of the bend section 7*b* of the conventional electromagnetic levitation type continuous metal casting apparatus (FIG. 1) are also shown so as to compare the temperatures between the electromagnetic levitation type continuous metal casting apparatus according to this feature of the present invention and the prior art. In considering Table 1, it should be remembered that the freezing point of copper, for example, is 1083° C.

TABLE 1

| | POINT A | POINT B | POINT C |
|---|---|---|---|
| EMBODIMENT | 1121° C. | 1177° C. | 1161° C. |
| PRIOR ART | — | 1176° | 958° C. |

As shown in the above table, in the case of the conventional electromagnetic levitation type continuous metal casting apparatus, the molten metal 1 supplied through the molten metal supply path 7 is cooled and freezes at the bend section 7*b* of the molten metal supply path 7 and thereby the flow of the molten metal 1 is stopped. In the case of FIG. 4 of the present invention, the molten metal 1 supplied through the molten metal supply path 7 is kept at a high temperature even at the bend section 7*b* of the supply path 7 and thereby high fluidity is maintained.

As was described above, according to the electromagnetic levitation type continuous metal casting apparatus of the present invention, the temperature of the molten metal 1 can be maintained over the entire area of the molten metal supply path 7. Thus, the molten metal 1 is smoothly supplied to the casting vessel 3 with nearly even fluidity over the entire length of the molten metal supply path 7. Consequently, even when a rod material is continuously cast at low speed, high quality products with equal sections and no breakage can be readily produced.

Figure 5:
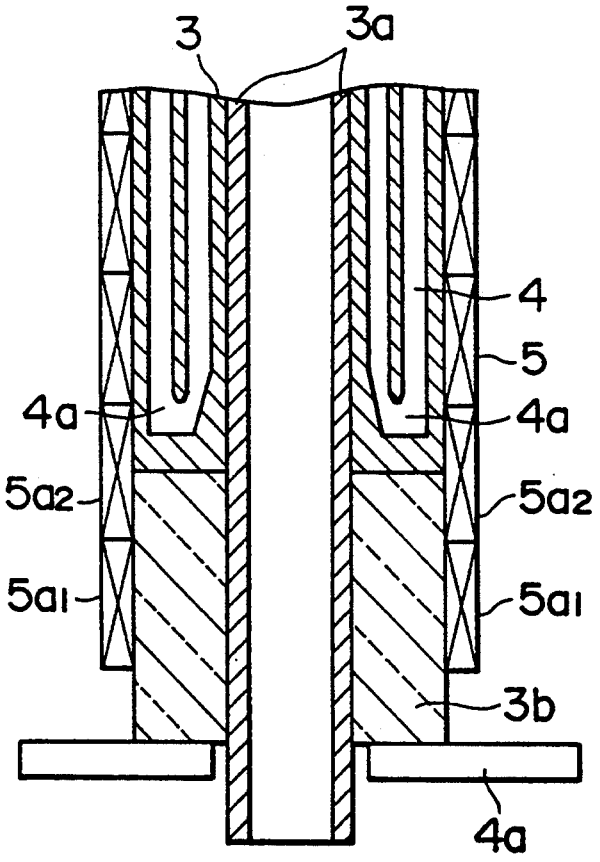
FIG. 5 is an enlarged sectional view showing the principal portions of the heat exchanger for an improved casting vessel according to a second feature of the invention.

A portion of an electromagnetic levitation type continuous metal casting apparatus according to a second feature of the invention is shown in FIG. 5 and comprises a molten metal storing furnace (not shown in FIG. 5) for holding and storing molten metal and supplying the same to a casting vessel 3 for upwardly forming and containing the molten metal 1 in the form of a molten metal column during solidification. The molten metal is formed into a column of predetermined size by an alternating electromagnetic field generation means 5 adjacent to but electrically and thermally insulated from the casting vessel-3 and disposed around the outer periphery thereof. Means 5 functions to generate an alternating electromagnetic field so as to electromagnetically levitate and maintain the upwardly moving molten metal column in a "pressureless contact" condition while it is levitated and contained in the casting vessel 3. The alternating electromagnetic field generation means 5 is comprised of a plurality of coils 5*a*1, 5*a*2, etc. The heat exchange means 4 is in thermal contact with the casting vessel 3 and a liner 3*a*, and is disposed around the outer periphery thereof, and causes a coolant to flow in the opposite direction both down and up relative to the upwardly moving molten metal column being levitated and contained in the casting vessel 3 during solidification (and upwardly moved as described earlier). During this interval of time, the alternating electromagnetic levitating and containment field maintains the molten metal column levitated against the force of gravity and contained out of pressure contact with the walls of the casting vessel 3 in a "pressureless contact" condition as explained in U.S. Pat. No. 4,414,285. This cools and solidifies the molten metal column. For simplicity, molten metal supply path 7 and the high frequency heating means 8 disposed around the outer periphery of the molten metal supply path 7 are not shown in FIG. 5.

The heat exchange means 4, according to the second feature of the invention, is structured as shown in FIG. 5 which is an enlarged sectional view. The heat exchange means 4 is in close thermal contact with the casting vessel 3 and disposed around the outer periphery thereof. The casting vessel 3 is provided with a graphite liner 3*a* around the inner wall surface thereof and has its outer wall in close thermal contact with the heat exchange means 4 in which the flow of the coolant is two-way. Electromagnetic levitation coils 5*a*1 and 5*a*2 of the alternating electromagnetic levitation and containment field generation means 5 are located so as to be disposed over the outer periphery of the flow path of the coolant within heat exchange means 4 adjoining the area where the flow of the coolant is reversed. The length of the alternating electromagnetic field generating means 5 is longer than that of the cooling means 4 so that on the inside of the electromagnetic levitation coils 5*a*1 and 5*a*2 the alternating electromagnetic levitating and containment field generating means are structured to extend more downwardly than the length of the heat exchange means 4. A thick, solid wall ceramic tube section 3*b* is part of the casting vessel 3 structure and is disposed below and supports heat exchange means 4. In more detail, the heat exchange means 4 is structured by a dual pipe portion 4*a* so as to reverse the direction of flow of the coolant at a point adjoining the electromagnetic levitation coils 5*a*1 and 5*a*2. The portion 4*a*, where the flow of the coolant is reversed, is positioned so that it adjoins the electromagnetic levitation coil 5*a*2 which is the second coil from the lower end of the plurality of coils 5a1, 5a2, etc. Some small adjustment between the relative vertical positions of the combined heat exchange means 4a and the unified casting assembly 3 and this adjoining region of the electromagnetic field generation means is desirable in order to obtain optimum casting results during operation.

The electromagnetic levitation type continuous metal casting apparatus shown in FIG. 5 was used in conjunction with a molten metal supply path 7 composed of a graphite tube as shown in FIG. 4 and a copper rod was continuously cast. With this arrangement, good rod product of homogeneous cross-section and free of breakage and voids was obtained. With the cooling mechanism (heat exchange means 4) and the position of the alternating electromagnetic field generation means coils 5a2 adjoining the cooling mechanism 4a structured as described above, the solidification of the molten metal column starts at an area where the levitating and inwardly directed containment forces satisfactorily act on the molten metal column within casting vessel 3. In other words, the molten metal column starts solidification where the column is being both levitated and contained and is in a "pressureless contact" condition whereby the sides of the casting vessel are not contacted with a continuous contact pressure and the effects of gravity and friction are eliminated. In addition, the molten metal is solidified while it is satisfactorily levitated and stirred. Thus, according to this second feature of the invention, a continuous metal casting process is provided which casts products that are free of voids or breakage and have a homogeneous cross-section.

In the aforementioned structure, by designing the alternating electromagnetic field generating means 5 so that it can be moved relative to the heat exchange means 4 and casting vessel 3 while being disposed around the outer periphery thereof, optimum conditions for making various types of products can be achieved. In the FIG. 5 embodiment of the invention, a cylindrically shaped graphite tube was used as the tube-shaped molten metal supply path However, other cross-sectional configurations can be used and electroconductive ceramics of the type listed in the description of FIG. 4 also can be used in practicing the invention.

Figure 6:
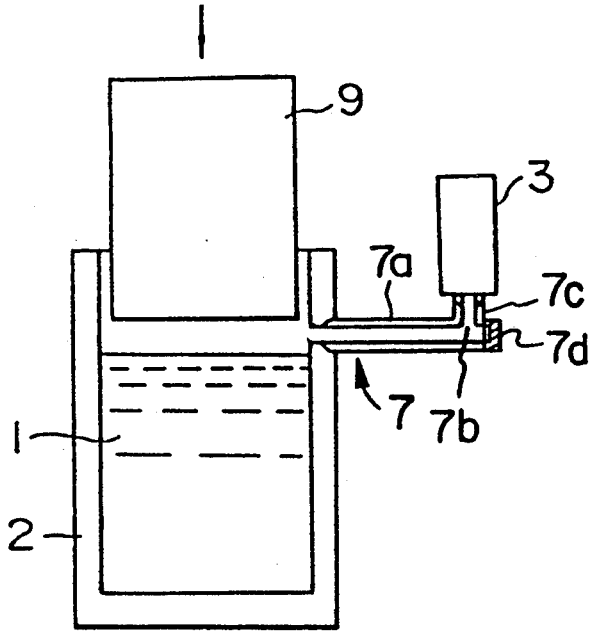
FIGS. 6 and 7 are sectional views showing the principal portions of an electromagnetic levitation type continuous metal casting apparatus according to a third feature of the present invention.

As shown by the sectional view of FIG. 6, the electromagnetic levitation type continuous metal casting apparatus according to a third feature of the invention comprises the molten metal storing furnace 2 for holding and storing the molten metal 1; a supply path 7 connected to a side surface of the molten metal storing furnace 2; and the casting vessel 3 sized to cast rod of a predetermined cross-section for upwardly receiving and holding the molten metal 1 being cast in the form of an upwardly extending, vertical, molten metal column supplied through the molten metal supply path 7. The casting vessel 3 also is provided with an alternating electromagnetic field generation means (not shown) and disposed around the outer periphery thereof for generating an alternating electromagnetic levitating and containment field for electromagnetically levitating and containing the moving molten metal column in the casting vessel 3. The alternating electromagnetic field generating means is composed of a plurality of interconnected coils and the cooling means is unified with the casting vessel 3 and disposed on the outer periphery thereof for cooling and solidifying the molten metal column as described earlier with respect to FIG. 5. The molten metal supply path 7 is provided with a high frequency heating means disposed around the outer periphery thereof as described earlier with relation to FIG. 4. In addition, the molten metal storing furnace 2 is provided with a displacer 9 which can be lowered into the metal to control the level of the molten metal 1 which is held in furnace 2 and for supplying the molten metal 1 into the casting vessel 3 through the supply path 7.

As shown in FIG. 6, when the displacer 9 is raised from the molten metal held in the molten metal storing furnace 2, the surface level of the molten metal drops below the tube-shaped molten metal supply path 7 which projects horizontally from a point high up on the side wall of the molten metal storing furnace 2. The design is such that the horizontally projecting portion of supply path 7 is substantially level with but just above the .top of the liquid surface of the molten metal in furnace 2 under this condition with the displacer block 9 raised out of the molten metal in the furnace. The vertical section 7c connected to the casting vessel 3 is structured with as short a length as possible. The molten metal storing furnace 2 is provided with a high frequency heating means on the peripheral wall thereof (not shown) so as to keep the molten metal in a molten state. This construction results in a reduction of hydrostatic pressure of the molten metal on any joints in the supply path 7 sub-system.

Figure 7:
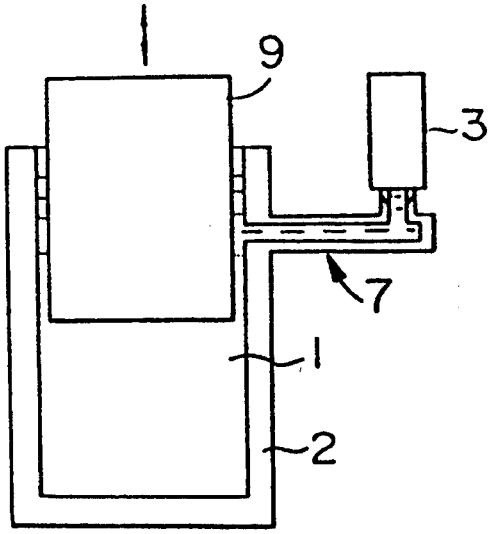

With reference to FIG. 7, the operation and usage of the electromagnetic levitation type continuous metal casting apparatus according to the third feature of the invention is shown. The molten metal storing furnace 2, the casting vessel 3, and the molten metal supply path 7 are designed so as to perform a particular continuous metal casting operation. When casting operations are started, the displacer 9 is driven downward so that the surface of the molten metal in storing furnace 2 is raised relative to the inlet to supply path 7 and casting vessel 3 and the alternating electromagnetic field generating means 5 is activated, as shown in FIG. 7. The rising level of the molten metal is supplied to casting vessel 3 from storing furnace 2 by supply path 7. Thus, by the downward operation of the displacer 9, the liquid surface of the molten metal 1 is gradually raised within casting vessel 3 relative to the field coils 5a1 and 5a2 in FIG. 5. The raised molten metal is supplied to the casting vessel 3 through the molten metal supply path 7 so as to perform the electromagnetic levitation type continuous metal casting operation described in U.S. Pat. No. 4,414,285, for example. When the displacer 9 is lifted up at the end of or to stop the casting operation, and the levitation field turned off, the surface of the liquid molten metal 1 in the molten metal storing furnace 2 drops, and any molten metal 1 in the molten metal supply path 7 as well as any molten metal in casting vessel 3 automatically flows back into the molten metal storage furnace and is collected therein in a self-draining manner.

Figure 3:
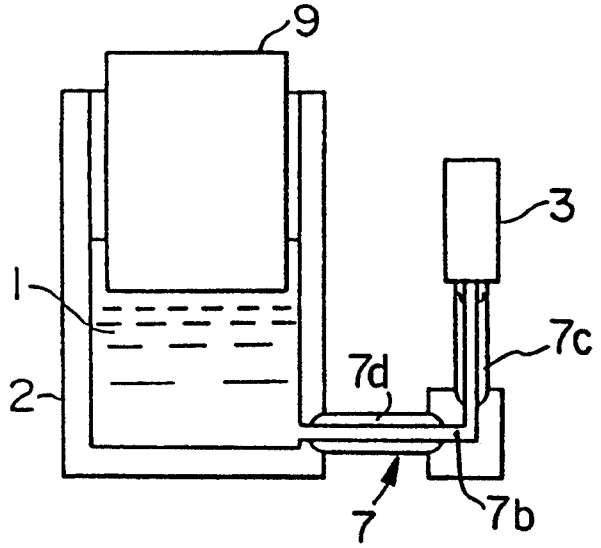
FIG. 3 PRIOR ART
FIG. 3 is a schematic functional view showing a prior art apparatus for supplying molten metal to be cast from a molten metal storing furnace having a displacer to control flow of molten metal to the casting vessel through a molten metal supply path for use in the conventional electromagnetic levitation type continuous metal casting apparatus of FIG. 1.

When a particular continuous metal casting operation is stopped using the FIG. 6 and FIG. 7 arrangements, the application of hydrostatic pressure by the molten metal 1 to the joints (if any) and other parts of the molten metal supply path 7, both during operation and during stand-by, is greatly reduced thereby obviating the problem of leakage of the molten metal 1. On the other hand, with respect to the maintenance of the molten metal supply path 7, because the molten metal automatically is collected back into the molten metal storing furnace 2, the solidification of metal in the supply path 7 while not actually casting but in a stand-by condition is prevented. This is due to the molten metal supply path 7 inlet being disposed at a relatively high position on the side wall of the furnace relative to the level of the molten metal surface in storing furnace 2. Because of this it is not necessary to remove any molten metal 1 in a separate operation since it automatically will be drained back into and maintained in the molten state within the furnace. Further, if it is desirable to repair or replace any parts of the supply path 7 or casting vessel 3, it is not necessary to drain the holding furnace as was required with the prior art arrangement of FIGS. 1 and 3.

As was described above, according to the electromagnetic levitation type continuous metal casting apparatus of FIGS. 6 and 7, when the casting operation is stopped, since the molten metal supply path system for supplying the molten metal to the casting vessel does not store the molten metal, no molten metal solidifies in the supply path system and the maintenance of the molten metal supply path becomes easy. In addition, since the molten metal supply path can be designed as shown in FIG. 7 so that it does not have joints between intermediate connecting sections, the probability of leakage of molten metal can be further reduced. In other words, when the casting operation is stopped, there is little or no hydrostatic pressure produced by the molten metal within the molten metal supply path system 7. Hence, the probability of leakage, even if there are joints in the supply path, is greatly reduced. Moreover, when the molten metal flow through the supply path is restarted, there is no requirement for disposal or removal of any cooled or solidified molten metal in the molten metal supply path 7. Consequently, according to the electromagnetic levitation type continuous metal casting apparatus of the present invention, many advantages such as safe operation, easy maintenance, and high efficiency of molten metal casting operation can be practically obtained.

Having described several embodiments of a new and improved electromagnetic levitation type continuous metal casting apparatus according to the invention, other modifications and variations of the invention will be suggested to those skilled in the art in the light of the above teachings. It is therefore to be understood that changes may be made in the particular embodiments of the invention described which are within the full intended scope of the invention as defined by the appended claims.

What is claimed is:

1. In an electromagnetic levitation continuous metal casting apparatus including a molten metal storing furnace for holding and storing a molten metal; a casting vessel for upwardly receiving and holding said molten metal in the form of an upwardly moving molten metal column; cooling means adjacent to and in heat exchange relationship with said casting vessel and disposed around the outer periphery thereof for cooling and solidifying said upwardly moving molten metal column; alternating electromagnetic levitation and containment field generation means adjacent to and disposed around the outer periphery of said casting vessel for generating an alternating electromagnetic levitation and containment field, said alternating electromagnetic levitation and containment field serving to electromagnetically levitate and contain said upwardly moving molten metal column within said casting vessel; the improvement comprising:

a tube-shaped molten metal supply path for supplying said molten metal to be cast from said molten metal storing furnace to said casting vessel, said tube-shaped molten metal supply path having:

(a) a horizontal section extending from said molten metal storing furnace, (b) a vertical section disposed for upwardly supplying said molten metal into said casting vessel, (c) a bend section intermediate said horizontal and vertical sections, and (d) an appendix section having a predetermined length disposed on the side of said bend section opposite said horizontal section;

first high frequency electromagnetic heating means disposed on the outer periphery of said horizontal and vertical sections of said tube-shaped molten metal supply path; and second, independent high frequency electromagnetic heating means disposed on the outer periphery of and along said length of said appendix section, said length of said appendix section predetermined to permit said second high frequency electromagnetic heating means to heat said bend section and to maintain the temperature of molten metal flowing through said bend section above its solidification temperature.

* * * * *